US009593691B2

(12) United States Patent
Rawcliffe

(10) Patent No.: US 9,593,691 B2
(45) Date of Patent: Mar. 14, 2017

(54) SYSTEMS AND METHODS FOR DIRECTING A FLOW WITHIN A SHROUD CAVITY OF A COMPRESSOR

(71) Applicant: General Electric Company, Schenectady, NY (US)

(72) Inventor: Gerald Austin Rawcliffe, Greenville, SC (US)

(73) Assignee: General Electric Company, Schenectady, NY (US)

( * ) Notice: Subject to any disclaimer, the term of this patent is extended or adjusted under 35 U.S.C. 154(b) by 526 days.

(21) Appl. No.: 13/946,262

(22) Filed: Jul. 19, 2013

(65) Prior Publication Data

US 2015/0023777 A1 Jan. 22, 2015

(51) Int. Cl.

| | |
|---|---|
| ***F03B 1/00*** | (2006.01) |
| ***F04D 27/02*** | (2006.01) |
| ***F04D 29/52*** | (2006.01) |
| ***F04D 29/54*** | (2006.01) |

(52) U.S. Cl.

CPC ..... *F04D 27/0207* (2013.01); *F04D 29/522* (2013.01); *F04D 29/545* (2013.01)

(58) Field of Classification Search

CPC .... F04D 27/0207; F04D 27/02; F04D 27/009; F04D 29/541; F04D 29/542; F04D 29/544; F04D 29/545; F04D 29/547; F05B 2270/1081

USPC ..... 415/220, 223, 221, 115, 116, 173.7, 415/174.4, 174.5

See application file for complete search history.

(56) References Cited

U.S. PATENT DOCUMENTS

| | | | | |
|---|---|---|---|---|
| 4,086,022 | A * | 4/1978 | Freeman | F01D 11/08 415/119 |
| 4,370,094 | A * | 1/1983 | Ambrosch | F01D 11/08 415/119 |
| 4,522,562 | A | 6/1985 | Glowacki et al. | |
| 4,571,937 | A * | 2/1986 | Albers | F01D 11/08 415/115 |
| 5,700,130 | A | 12/1997 | Barbot et al. | |
| 6,055,804 | A | 5/2000 | Hammond et al. | |
| 8,308,429 | B2 * | 11/2012 | Walker | F04D 19/022 415/144 |
| 2009/0317232 | A1 * | 12/2009 | Guemmer | F01D 5/225 415/58.5 |
| 2010/0158684 | A1 | 6/2010 | Baralon | |

FOREIGN PATENT DOCUMENTS

| | | | | |
|---|---|---|---|---|
| GB | 826669 A * | 1/1960 | | F04D 29/542 |

* cited by examiner

*Primary Examiner* — Eric Keasel
*Assistant Examiner* — Jason Mikus
(74) *Attorney, Agent, or Firm* — Sutherland Asbill & Brennan LLP

(57) ABSTRACT

A compressor is disclosed herein. The compressor may include a shroud cavity. The compressor also may include a flow directing device positioned within the shroud cavity. The flow directing device may be configured to direct a flow within the shroud cavity.

10 Claims, 3 Drawing Sheets

SYSTEMS AND METHODS FOR DIRECTING A FLOW WITHIN A SHROUD CAVITY OF A COMPRESSOR

FIELD

Embodiments of the disclosure relate generally to gas turbine engines and more particularly relate to systems and methods for directing a flow within a shroud cavity of a compressor.

BACKGROUND

Gas turbine engines with shrouded stator vanes within the compressor may suffer from hot day stall issues resulting from the increased airflow needed to maintain output with lower density flow. The stall may limit the power output of gas turbine engines on hot days by forcing vanes to close to maintain an adequate stall margin. Stall may be attributed to flow separation on the leading edge of the stators as a result of a relative tangential velocity between the rotating structure (i.e., rotor) and the stator shroud. Reducing the relative tangential velocity has been shown to improve hot day performance.

BRIEF DESCRIPTION

Some or all of the above needs and/or problems may be addressed by certain embodiments of the disclosure. According to one embodiment, there is disclosed a compressor. The compressor may include a shroud cavity. The compressor also may include a flow directing device positioned within the shroud cavity. The flow directing device may be configured to direct a flow within the shroud cavity.

According to another embodiment, there is disclosed a system. The system may include a compressor comprising a shroud cavity therein. The system also may include a combustion system in communication with the compressor. Moreover, the system may include a turbine in communication with the combustion system. Further the system may include a flow directing device positioned within the shroud cavity. The flow directing device may be configured to direct a flow within the shroud cavity.

Further, according to another embodiment, there is disclosed a method for directing a flow within a shroud cavity of a compressor. The method may include positioning a flow directing device within the shroud cavity. The method also may include flowing a flow within the shroud cavity. Moreover, the method may include converting, by the flow directing device, tangential velocity of the flow within the shroud cavity to axial velocity.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale.

DETAILED DESCRIPTION

Figure 1:
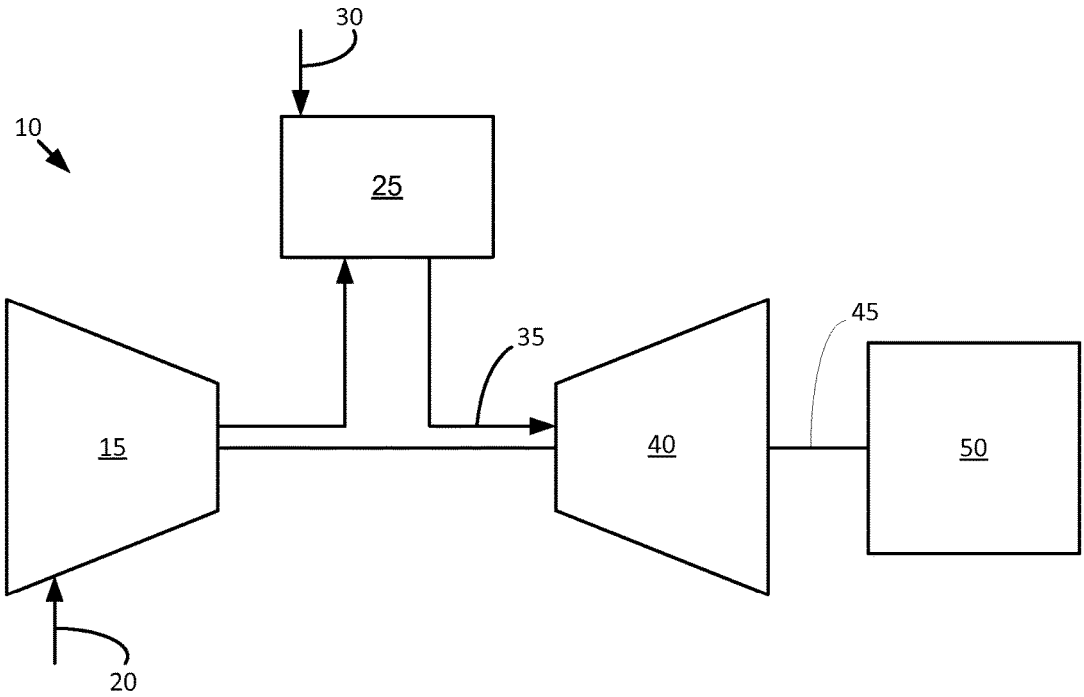
FIG. 1 schematically depicts an example top view of a gas turbine engine assembly, according to an embodiment of the disclosure.

Illustrative embodiments will now be described more fully hereinafter with reference to the accompanying drawings, in which some, but not all embodiments are shown. The disclosure may be embodied in many different forms and should not be construed as limited to the embodiments set forth herein. Like numbers refer to like elements throughout.

Illustrative embodiments of the disclosure are directed to, among other things, systems and methods for directing a flow within a shroud cavity of a compressor. In certain embodiments, the compressor may include a static outer casing. A rotor may be disposed within the static outer casing. An array of stator vanes may be attached to the static outer casing between the static outer casing and the rotor. The rotor may include a recess about the array of stator vanes opposite the static outer casing. A stator shroud may be attached to the array of stator vanes opposite the static outer casing and at least partially within the recess. In this manner, the stator shroud and the recess may form the shroud cavity. The rotor also may include an array of blades attached thereto. The array of blades may be positioned adjacent to the array of stator vanes to form a compressor stage.

The compressor may include a primary flow and a secondary flow. The primary flow may include a flow of fluid (such as air) between the static outer casing and the rotor. The secondary flow may include a flow of fluid (such as air) within the shroud cavity. In some instances, the secondary flow may be a diverted flow from the primary flow. For example, the secondary flow may be a "leakage" flow within the shroud cavity from the primary flow.

In certain embodiments, a flow directing device may be positioned within the shroud cavity. The flow directing device may be configured to alter velocity components of the secondary flow within the shroud cavity to produce a more favorable velocity profile for improving hot day stall margin of the engine. For example, in certain embodiments, the flow directing device may be configured to convert tangential velocity of the secondary flow within the shroud cavity to axial velocity, thereby mitigating flow separation. In some examples, the flow directing device may include one or more channels, one or more blunt bodies, one or more nubs, one or more walls, one or more vanes, and/or one or more static features or the like configured to convert tangential velocity of the secondary flow within the shroud cavity to axial velocity. In some instances, the flow directing device may be positioned on a surface of the stator shroud within the shroud cavity, such as the radially inner surface of the stator shroud. For example, the flow directing device may include one or more channels formed on the radially inner surface of the stator shroud within the shroud cavity. In other instances, the flow directing device may include one or more channels formed within the stator shroud within the shroud cavity. The flow directing device may be any structure, device, system, or the like configured to convert tangential velocity of the secondary flow within the shroud cavity to axial velocity.

Referring now to the drawings, FIG. 1 shows a schematic view of gas turbine engine 10 as may be used herein. The gas turbine engine 10 may include a compressor 15. The compressor 15 compresses an incoming flow of air 20. The compressor delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. In this example, the combustor 25 may be in the form of a number of can combustors as will be described in more detail below. The flow of combustion gases 35 is in turn delivered to a downstream turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be anyone of a number of different gas turbine engines such as those offered by General Electric Company of Schenectady, New York and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
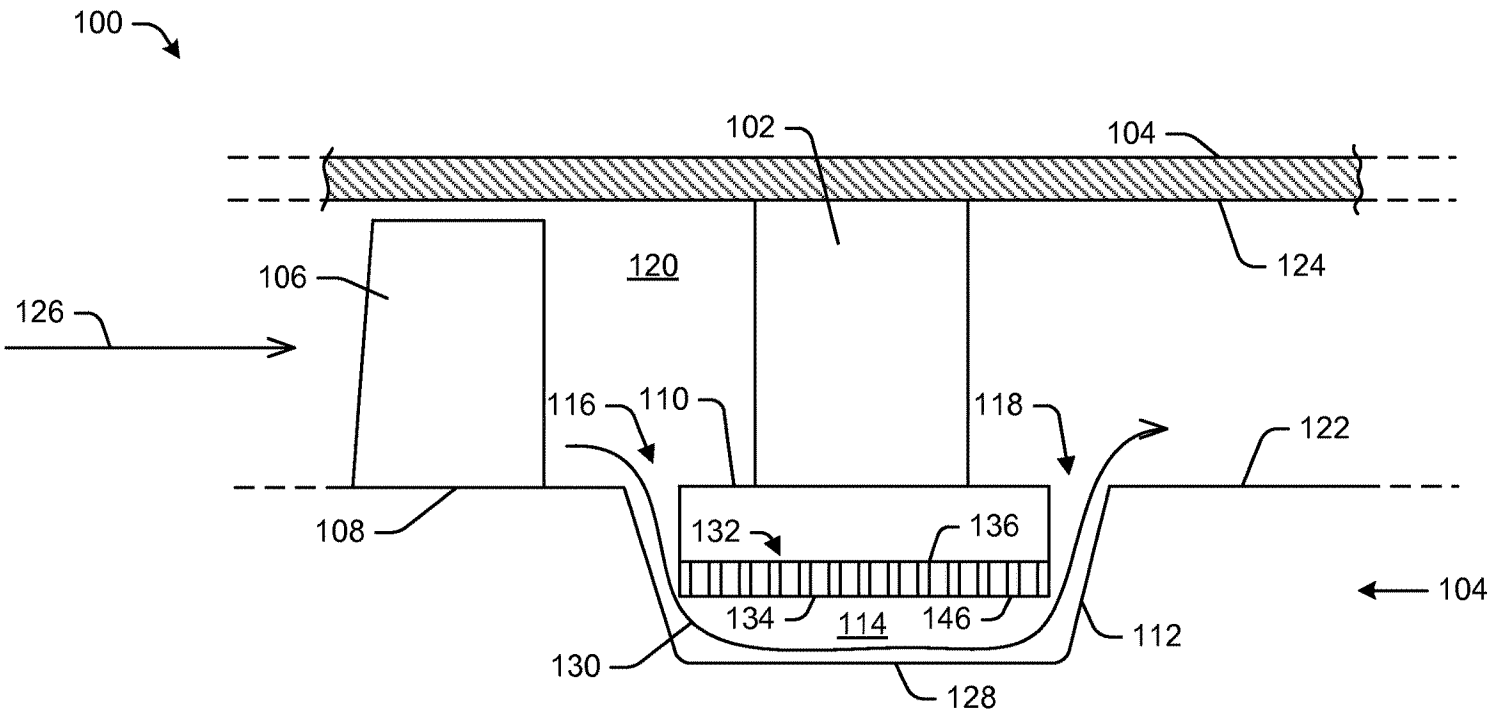
FIG. 2 schematically depicts an example side view of a portion of a compressor assembly, according to an embodiment of the disclosure.

FIG. 2 schematically depicts one example embodiment of a portion of a compressor 100. The geometry of the compressor 100 has been simplified in FIG. 2 for clarity. The compressor 100 may include an annular array of stationary stator vanes 102 attached to a static casing structure 104. The compressor 100 also may include an array of rotatable blades 106 attached to a rotor 108. A stator shroud 110 may be located inside a recess 112 extending axially underneath the stator vanes 102 to form a shroud cavity 114. The recess 112 may provide a clearance between the stator vanes 102 (including the stator shroud 110) and the rotor 108.

The shroud cavity 114 may include an intake 116 between the stator shroud 110 and the rotor 108 on an upstream side thereof. Similarly, the shroud cavity 114 may include an outtake 118 between the stator shroud 110 and the rotor 108 on a downstream side thereof.

The static casing structure 104 and the rotor 108 together may form a first flow passage 120. For example, the stator shroud 110 and the rotor 108 may form an inner wall 122 of the first flow passage 120, and the static casing structure 104 may form an outer wall 124 of the first flow passage 120. The first flow passage 120 may include a primary flow 126 therein. The stator shroud 110 and the recess 112 may form a second flow passage 128. The second flow passage 128 may include a secondary flow 130 therein between the intake 116 and the outtake 118. The secondary flow 130 may be a diverted flow from the primary flow 126.

In certain embodiments, a flow directing device 132 may be positioned within the shroud cavity 114. The flow directing device 132 may be configured to alter velocity components of the secondary flow 130 within the shroud cavity 114 to produce a more favorable velocity profile for improving hot day stall margin of the engine. For example, in certain embodiments, the flow directing device 132 may be configured to convert tangential velocity of the secondary flow 130 within the shroud cavity 114 to axial velocity. For example, the flow directing device 132 may include one or more channels, one or more blunt bodies, one or more nubs, one or more walls, one or more vanes, and/or one or more static features of the like configured to convert tangential velocity of the secondary flow 130 within the shroud cavity 114 to axial velocity. Any device or combination thereof may be used to direct the secondary flow 130 within the shroud cavity 114. The flow directing device 132 may partially or wholly extend the axial length of the shroud cavity 114. Similarly, the flow directing device 132 may partially or wholly extend the radial depth of the shroud cavity 114.

Figure 3:
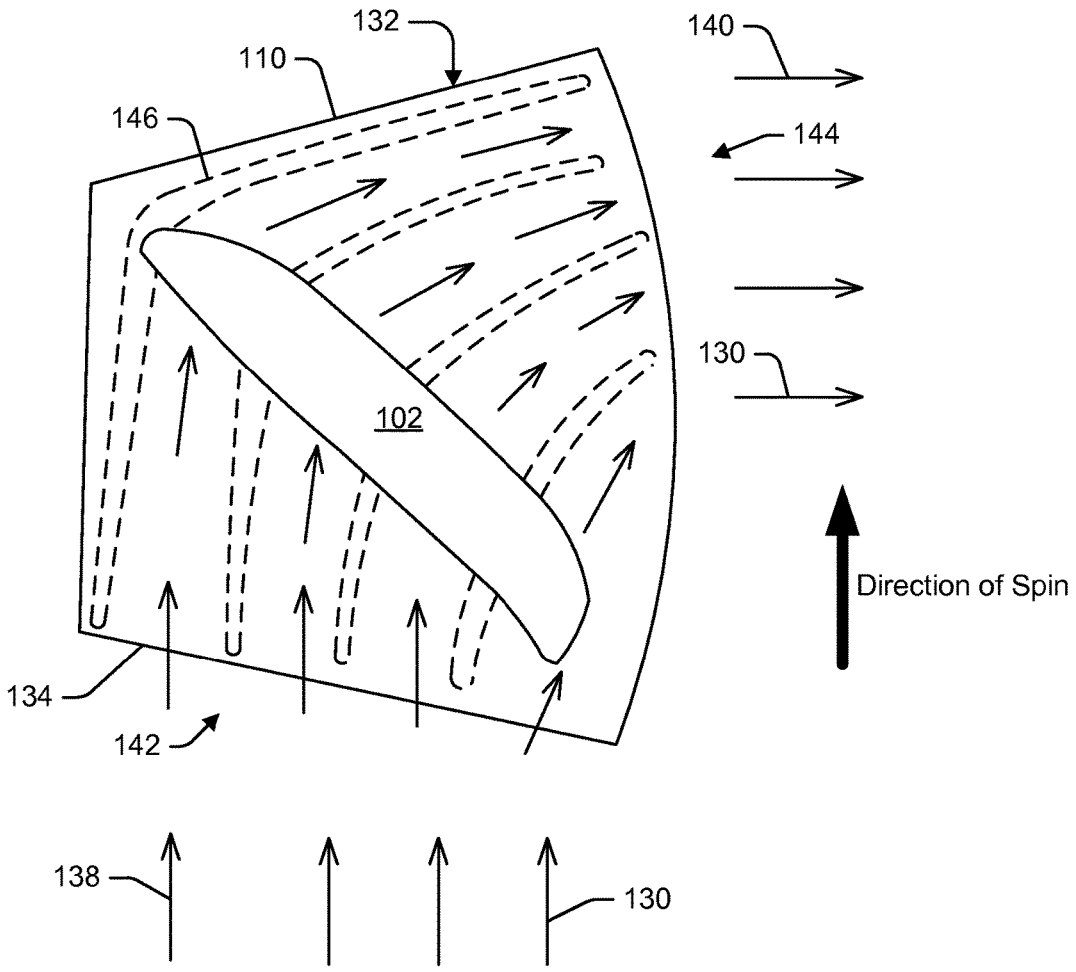
FIG. 3 schematically depicts an example top view of a compressor assembly, according to an embodiment of the disclosure.

As depicted in FIGS. 2 and 3, in certain embodiments, the flow directing device 132 may be positioned on a surface of the stator shroud 110 within the shroud cavity 114. For example, the flow directing device 132 may include one or more channels 134. The one or more channels 134 may be positioned on a radially inner surface 136 of the stator shroud 110 within the shroud cavity 114. The one or more channels 134 may be configured to alter velocity components of the secondary flow 130 within the shroud cavity 114 to produce a more favorable velocity profile for improving hot day stall margin of the engine. For example, in certain embodiments, the one or more channels 134 may be configured to convert tangential velocity 138 of the secondary flow 130 within the shroud cavity 114 to axial velocity 140. For example, the one or more channels 134 may include an inlet 142 that is generally parallel to the tangential velocity 138. The one or more channels 134 also may include a curvature or the like that converts the tangential flow to axial flow. In this manner, the one or more channels 134 may include an exit 144 that is generally parallel to the axial velocity 140. The one or more channels 134 may be formed between one or more protrusions 146, which may comprise one or more blunt bodies, one or more nubs, one or more walls, one or more vanes, or one or more static features.

The secondary flow 130 may enter the shroud cavity 114 by way of the intake 116. The rotation of the rotor 108 about the shroud cavity 114 may impart tangential velocity 138 to the secondary flow 130. The tangential velocity 138 of the secondary flow 130 may enter the inlet 142 of the channels 134. The channels 134 may then convert the tangential velocity 138 of the secondary flow 130 to axial velocity 140 via the curvature of the channels 134. The secondary flow 130 may then exit the channels 134 by way of the exit 144 and thereafter exit the shroud cavity 114 in the axial direction by way of the outlet 118.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A compressor, comprising:

a primary flow;

a shroud cavity comprising a secondary flow therein, wherein the shroud cavity comprises an intake on an upstream end thereof and an outlet on a downstream end thereof, wherein the secondary flow flows from the intake to the outlet; and a flow directing device positioned within the shroud cavity, wherein the flow directing device converts a tangential velocity of the secondary flow within the shroud cavity to an axial velocity that exits the outlet on the downstream end of the shroud cavity, wherein the flow directing device comprises a plurality of curved channels formed between a plurality of protrusions on a surface within the shroud cavity, wherein the one or more curved channels comprise an inlet that is parallel to the tangential velocity and an exit that is parallel to the axial velocity.

2. The compressor of claim 1, wherein the flow directing device is configured to alter velocity components of the secondary flow within the shroud cavity to produce a more favorable velocity profile for improving hot day stall margin.

3. The compressor of claim 1, further comprising:

a static outer casing;

a rotor disposed within the static outer casing;

an array of stator vanes attached to the static outer casing, wherein the array of stator vanes is positioned between the static outer casing and the rotor;

a recess formed within the rotor about the array of stator vanes opposite the static outer casing; and a stator shroud attached to the array of stator vanes opposite the static outer casing at least partially within the recess, wherein the stator shroud and the recess form the shroud cavity.

4. The compressor of claim 3, wherein the flow directing device is positioned on a surface of the stator shroud within the shroud cavity.

5. The compressor of claim 3, further comprising an array of blades attached to the rotor, wherein the array of blades are positioned adjacent to the array of stator vanes to form a compressor stage.

6. A system, comprising:

a compressor comprising a primary flow and a shroud cavity with a secondary flow therein, wherein the shroud cavity comprises an intake on an upstream end thereof and an outlet on a downstream end thereof, wherein the secondary flow flows from the intake to the outlet;

a combustion system in communication with the compressor;

a turbine in communication with the combustion system; and a flow directing device positioned within the shroud cavity, wherein the flow directing device converts a tangential velocity of the secondary flow within the shroud cavity to an axial velocity that exits the outlet on the downstream end of the shroud cavity, wherein the flow directing device comprises a plurality of curved channels formed between a plurality of protrusions on a surface within the shroud cavity, wherein the one or more curved channels comprise an inlet that is parallel to the tangential velocity and an exit that is parallel to the axial velocity.

7. The system of claim 6, wherein the flow directing device is configured to alter velocity components of the secondary flow within the shroud cavity to produce a more favorable velocity profile for improving hot day stall margin.

8. The system of claim 6, wherein the compressor further comprises:

a static outer casing;

a rotor disposed within the static outer casing;

an array of stator vanes attached to the static outer casing, wherein the array of stator vanes is positioned between the static outer casing and the rotor;

a recess formed within the rotor about the array of stator vanes opposite the static outer casing; and a stator shroud attached to the array of stator vanes opposite the static outer casing at least partially within the recess, wherein the stator shroud and the recess form the shroud cavity.

9. The system of claim 8, wherein the flow directing device is positioned on a surface of the stator shroud within the shroud cavity.

10. The system of claim 8, further comprising an array of blades attached to the rotor, wherein the array of blades are positioned adjacent to the array of stator vanes to form a compressor stage.

* * * * *